United States Patent [19]

Muller

[11] 4,401,744

[45] Aug. 30, 1983

[54] DIAZOTYPE COMPOSITIONS WITH IMPROVED PRINTING PERFORMANCE

[75] Inventor: Peter Muller, Port Washington, N.Y.

[73] Assignee: Andrews Paper & Chemical Co., Inc., Port Washington, N.Y.

[21] Appl. No.: 260,930

[22] Filed: May 6, 1981

Related U.S. Application Data

[63] Continuation of Ser. No. 835,495, Sep. 22, 1977, abandoned.

[51] Int. Cl.[3] ..... G03C 1/60

[52] U.S. Cl. ..... 430/179; 430/150; 430/157; 430/171; 430/177; 430/183; 430/186; 430/187; 430/180; 430/181; 430/182

[58] Field of Search ..... 430/179, 177, 171, 151, 430/183, 186, 187, 157, 150, 180, 181, 182

[56] References Cited

U.S. PATENT DOCUMENTS 2,727,820 12/1955 Botkin et al. .
2,732,299 1/1956 Morrison .
2,755,185 7/1956 Sulich .
3,076,707 2/1963 Lawton et al. .
3,169,067 2/1965 Berman et al. .
3,284,201 11/1966 Meijs et al. .
3,316,092 4/1967 Klimkowski et al. .
3,360,369 12/1967 Amariti et al. .
3,420,666 1/1969 Welch et al. .
3,453,112 1/1969 Schaeffer .

*Primary Examiner*—Charles L. Bowers, Jr.
*Attorney, Agent, or Firm*—Kane, Dalsimer, Kane, Sullivan & Kurucz

[57] ABSTRACT

Disclosure is made of a light-sensitive diazo coating composition and a light-sensitive diazotype reproduction material comprising a base with at least one coating layer comprising a light sensitive diazo compound, coupling component, a stabilizing acid and salt, and a development accelerating and stabilizing composition of 1,3-dimethylurea with urea or with thiourea, which also improves sensitizing solution compatibility and increases printing speed.

30 Claims, No Drawings

DIAZOTYPE COMPOSITIONS WITH IMPROVED PRINTING PERFORMANCE

This is a continuation of application Ser. No. 835,495 filed Sept. 22, 1977 abandoned.

BACKGROUND OF THE INVENTION

1. Field of the Invention

This invention relates to diazotype coating compositions and reproduction materials. More specifically the present invention relates to 2-component diazotype material for both ammonia and amine development.

2. Brief Description of the Prior Art

The diazotype reproduction process is well known to the art and is described in great detail in "Light Sensitive Systems" by Jaromir Kosar, John Wiley & Sons, Inc., N.Y. 1965, and in "Reproduction Coating" by E. Jahoda, 4th Edition Andrews Paper & Chemical Co., Inc. Port Washington, N.Y. A more recently commercialized diazotype process for liquid amine development is described in U.S. Pat. Nos. 3,446,620 and 3,490,908. The two-component diazotypes for amine development are formulated for best performance in amine development (also called pressure development) machines which is in general detrimental to their performance in ammonia vapor development equipment. Diazotype materials for the amine development process, in general, do not develop fast enough in ammonia vapor development equipment and thus the trade is supplied with two different grades of diazotypes, one for ammonia and another one for amine development, for best performances. The present invention has equal applicability to both amine and ammonia development systems in that the compositions of the invention may be used to prepare diazotype reproduction materials that perform equally well in amine development machines and in ammonia vapor development processors.

Diazotype compositions for the two-component process comprise at least one diazo compound, at least one coupler and acidic stabilizers which are necessary to obtain a diazotype copy. Further components for such diazotype compositions may include:

1. development accelerators to minimize the necessary ammonia or amine concentration in the developing environment;
2. antioxidants to stabilize diazotype prints against discoloration under daylight exposure;
3. contrast controlling compounds; and
4. solubilizers which improve the compatibility of the various components in the sensitizing solution.

Sometimes such components fulfill more than one of these functions and often they have side effects which are detrimental to the quality of diazotype reproduction material.

It is one objective of this invention to produce improved diazotype compositions which overcome the above-mentioned shortcomings and the invention achieves that objective.

The rate of development of diazotypes for the dry process has become important recently as it is directly related to the necessary ammonia concentration in the developing machines. For environmental considerations it is of great interest to keep the ammonia concentrations at the lowest possible levels. Therefore, it is now important to provide for accelerated development of diazotypes. Desirably, acceleration is achieved without affecting print quality which is directly related to the degree of development. For example, print contrast, which can be defined by the Gamma value of the sensitometric curve of the diazotype material and can also be described as the optical density difference between full tone print line and print background, is easily affected by the degree of development. The rate of development of a diazotype will thus be a controlling factor for print contrast.

In the past, glycerine and glycols have been widely used as development accelerators because of their hydroscopic qualities. These compounds, however, tend to migrate into the sheet and, thus, their effect decreases during storage of the sensitized material. If they are applied in excessive concentrations, on the other hand, the sensitized paper loses its storage stability through precoupling which means formation of the print dye before the sensitized paper is used for the copying process. Another compound widely used as a development accelerator is hydroxyethyl-allyl-thiourea (described in U.S. Pat. No. 2,755,185). While this compound does not tend to migrate, it is rather expensive and only active with a very limited number of coupling components.

The most generally used antioxidizing agent in diazotype compositions is thiourea which strongly affects the shades of the print colors by, for example, shifting violet hues towards blue tones and increasing the brilliance of the print colors. Thiourea, however, is not of great value for development acceleration and thus tends to reduce print contrast with low ammonia concentrations in the development environment when full print development is not achieved. Moreover, there have been various literature references citing tumors in animals from ingestion of thioure and thiourea derivatives, thus making thiourea suspect of carcinogenic properties. Accordingly it would be advantageous to reduce or eliminate thiourea from diazo compositions.

The commercially available base paper for diazotype coatings is generally adjusted to an acid pH at the paper mill. The pH adjustment is made by addition of aluminum sulfate. Thus, diazotype base paper may contain various concentrations of aluminum sulfate which is a good stabilizer for diazotype compositions against premature decomposition of diazonium compounds and against precoupling. Its application however, is very restricted as its presence in diazotype compositions greatly reduces the rate of development. This effect is particularly pronounced when it is used with 2,3-dihydroxynaphthalene as a coupler component or with the corresponding acid sulfonated in the six-position. The aluminum ion seems to form a complex with these couplers to inhibit coupling.

A very useful component of diazotype compositions is zinc chloride which is beneficial for the shelf life of sensitized diazotype materials. It can also be used to adjust the rate of development and print contrast in many cases. Its application however, is often limited because it reduces the solubility of diazo compounds and the solution compatibility of diazo compounds with various couplers. The addition of solubilizers can improve tolerance for zinc chloride but an active solubilizing agent such as caffein tends also to render the print dye more water soluble, which is not desirable. I have now found that the use of a combination of 1,3-dimethylurea with urea or with thiourea in diazotype compositions, in replacement of thiourea, or instead of thiourea alone, produces improved diazotype coating compositions and reproduction materials by overcoming many of the above-described problems of the prior art.

In particular, a great increase in the rate of development is obtained with an ensuing improved print color brilliance. Moreover, the solution compatibility of diazo compounds, couplers, and zinc chloride is greatly improved eliminating the risk of oily precipitations, in particular, at lower operating temperatures. I have also found that the above-detailed improved performance of diazotypes could not be obtained from the use of either of the compounds alone; i.e.; 1,3-dimethylurea or urea or thiourea alone. It appears that the combination with 1,3-dimethylurea generates a synergistic effect. I have also discovered that the brilliance of the print color was greatly superior when a mixture of 1,3-dimethylurea with urea or with thiourea was used instead of thiourea alone in the diazo coating composition. Appropriate print colors could be thus obtained with stoichiometric ratios of diazo and coupler while with thiourea or urea alone, 60 to 70% coupler excess is necessary to achieve similar results. There is of course an economic advantage in reducing the amount of coupler required. Thus, it is obvious that the application of this invention leads to more economical diazotype reproduction materials, as its compounds replace more costly components.

Contrary to all expectations, I have also found that aluminum sulfate can be used in diazotype compositions, with some couplers, with the result of an improved shelf life as well as an improved rate of development when 1,3-dimethylurea in mixture with urea or thiourea or both, is present. The improved toleration of aluminum sulfate with minimum adverse effects is outstanding even in the case of the 2,3-dihydroxynaphthalene couplers, in the presence of 1,3-dimethylurea in mixture with urea or thiourea.

The sensitivity to ultraviolet light of diazotypes reflects, for practical purposes, in their printing speed. While the printing speed is primarily reciprocally proportionate to the concentration of the diazo compound, various other compounds have a secondary influence on the printing speed. For example, by activating or deactivating the diazo compound, or by influencing its penetration into the base. Since the diazo concentration also controls the maximum obtainable print dye yield, it is desirable to formulate a diazotype composition that allows the fastest printing speed for a given diazo compound concentration. I have now found that diazotype compositions containing mixtures of 1,3-dimethylurea with urea or with thiourea produce diazotype copies with a faster printing speed than diazotype compositions without 1,3-dimethylurea.

The introduction of precoating in the diazotype (see TAPPI, Vol. 48, #8 pp. 55A–59A, August 1965) has greatly enhanced the print color brilliancy of diazotypes. The light-sensitive coating composition, however, has also a strong effect on the overall result regarding print brilliancy as well as color shade. I have discovered that diazotype compositions containing mixtures of 1,3-dimethylthiourea with urea or thiourea further enhance the brilliancy of the print dyes.

Other advantages of the compositions and reproducing materials of the invention will be described more fully hereinafter.

SUMMARY OF THE INVENTION

The invention comprises a light-sensitive diazo coating composition, which comprises; a diazonium compound, 1,3-dimethylurea, an acid stabilizer and a compound selected from the group consisting of urea, thiourea and mixtures thereof.

The invention also comprises a light-sensitive diazotype reproduction material, which comprises; a base support; and a coating on the support, which comprises in admixture a diazonium compound, 1,3-dimethylurea, an acid stabilizer and a compound selected from the group consisting of urea, thiourea and mixtures thereof.

The invention also comprises the method of making and using the reproduction material of the invention.

Detailed Description of the Preferred Embodiments of the Invention

The diazo coating compositions of the invention include a diazonium compound. Aromatic diazo compounds of more or less pronounced yellow color and which absorb ultraviolet light to undergo a photolytical decomposition to colorless products are advantageously used. Such diazonium compounds and the method of their preparation are well known in the art. Representative of diazonium compounds used in the invention are:

1. Derivatives of 1-diazo-4-amino benzene with or without alkyl, oxylalkyl or halogen substitutions in the benzene ring and with alkyl or dialkyl or acyl or acylalkyl substitution on the amino nitrogen or with the amino nitrogen forming a member of a heterocyclic ring with or without a second hetero atom of oxygen or nitrogen.
2. Derivatives of 1-diazo-4-alkylaryl mercapto benzene with or without substitution in the benzene ring.
3. Derivatives of 1-diazo-4-phenyl benzene with and without substitution in the phenyl and in the benzene rings.
4. 2-Diazo-1-hydroxy-naphthalene-5-sulfonic acid, and the like.

The coating compositions of the invention also include 1,3-dimethylurea and urea or thiourea, all of which are well known compounds as is the method of their preparation; see for example U.S. Pat. Nos. 2,357,149 and 2,857,430.

An acid stabilizer is a necessary ingredient of the compositions of this invention. Any of the well known acid stabilizers previously used in light-sensitive diazo coating compositions may be used. Representative of such acid stabilizers are citric acid, tartaric acid, hydrochloric acid, sulfuric acid, boric acid mixtures thereof and the like.

In preferred compositions of the invention, azo couplers are mixed with the diazonium compounds in an acid environment to prevent precoupling. When changing the pH from an acid to an alkaline pH, the coupling reaction occurs to produce an azo dye as is known in the art. Azo couplers are generally aromatic compounds with phenolic hydroxyl groups with or without other substituent groups. The couplers are generally colorless. Representative of azo couplers are:

1. Resorcinol and its halogen and alkyl derivatives and ethers;
2. Resorcylic acids with or without halogen substitution in the ring and their amides and substituted amides;
3. dihydroxy naphthalene mono sulfonic acids and disulfonic acids;
4. Dihydroxy naphthalenes;
5. Beta and alpha-hydroxy naphthoic acid amides and substituted amides;
6. Compounds with active methylene groups such as aceto-acet derivatives and cyano acet derivatives;
7. Mono and poly hydroxy biphenyls;
8. Poly hydroxy biphenyl sulfides;

9. Pyrazolone derivatives;
10. Amino phenol derivatives; and the like.

The light-sensitive diazo coating compositions of the invention may contain any number of additional ingredients conventionally used in the preparation of prior art light-sensitive coating compositions such as, for example, solubilizers, fillers, stabilizers, accelerators, solvents, anti-oxidants, contrast controlling compounds and the like.

The proportions of the various components of the compositions of the invention may be those proportions conventionally used in their use prior to this invention, in the preparation of prior art diazo light-sensitive compositions (where they were so used). These proportions are well known to those skilled in the art; see for example the disclosures of Kosar, supra. and of U.S. Pat. Nos. 3,923,518 and 3,996,056. The proportion of 1,3-dimethylurea employed in the preparation of the compositions of the invention may be that proportion which will provide in a coating on a base support, from 10 to 5000 mg per square meter of base support. In general, aqueous diazo coating mixtures containing from about 1 gm/liter to about 150 gms/liter, preferably 10 to 80 gms/liter of 1,3-dimethylurea will provide coatings of desired concentration.

The compositions of the invention may be prepared by simple admixture of the ingredients in a suitable mixing vessel. Preferably the compositions of the invention are prepared by admixture in an aqueous media for use as an aqueous coating mixture to prepare diazotype reproduction materials of the invention. The order of mixing is not critical. However, the mixture of 1,3-dimethylurea with urea or thiourea is normally introduced into the diazo sensitizing solution. It is possible, however, to add one or both components to a precoat preparation instead or at least one of the components of the compositions of this invention to either one of the diazo or precoat coating preparations and the remaining components to the other of the coating preparations. The preferred procedure includes the 1,3-dimethylurea in the light-sensitizing composition, in particular when its solubilizing effect is needed for improving the solution compatibility of other components of the compositions of the invention.

The diazotype reproduction materials of the invention may be prepared by coating aqueous mixtures of the compositions of the invention on a suitable base support material, using conventional diazo coating apparatus. The techniques are well known; see for example U.S. Pat. Nos. 3,923,518 and 3,996,056. Representative of suitable base supports are thermoplastic, polymeric resin films, foils including metal foils, cloth, opaque paper, translucent papers and like supports. Preferred are the commercially available diazotype papers previously described. The excellent solubility of 1,3-dimethylurea in polar organic solvents such as methanol, ethanol, isopropanol, glycol ethers, butyl acetate and the like make this invention also applicable to diazotype coatings applied from organic solvent systems to plastic films, metal, and like useful base supports.

In preparing the diazotype reproduction materials of the invention, it is preferred that the compositions of the invention be applied in the diazo coating so as to leave from 140 to 2000 mg of 1,3-dimethylurea per square meter of base support. Most preferably the diazo coating will also include from 50 to 1500 mg of urea and/or thiourea per square meter of base support, most preferably from 50 to 150 mg.

The following examples describe the manner and method of making and using the invention and set forth the best mode contemplated by the inventor but are not to be construed as limiting. All parts specified are by weight unless otherwise stated.

Where specified, test results were obtained by the following procedures.

Test No. 1—Rate of Development (a) Ammonia vapor development

A 2-component diazotype sheet is passed a number of times through the ammonia-developing section of any commercial diazo copying machine in which the ammonia concentration, through reduced feed or dilution of the ammonia, has been reduced to a level which is far below the normal concentration (it is unnecessary to establish an exact concentration because the test serves only to compare the performance of 2 or more different diazotype sheets). In order to differentiate high and low temperature rates of development, the development tests can be made in both hot and cold developing machines. Between each pass, through the developing section, the sheet is partially exposed to UV light to decompose unreacted diazo compound. In this manner "development-step-wedges" can be obtained and compared with each other as to degree of development. A test sheet of $2\frac{1}{2}''\times 8''$ is thus marked on its length side with 4 to 5 pencil marks, 1 inch apart from each other. It is passed through the developer section and thereupon the sensitized side is covered with a black opaque sheet of the same size, but so that it leaves a strip of $1''\times 2\frac{1}{2}''$ uncovered. The sheets are exposed in this position to UV light by passing them through the printing section of a diazo copying machine. The black opaque cover sheet is then removed and the diazotype sheet is passed a second time through the developing section. The diazotype sheet is then again covered with the black opaque sheet so that this time it leaves the first strip of $1''\times 2$–$12''$ plus a second strip of $1''\times 2\frac{1}{2}''$ or a total area of $2''\times 2$–$12''$ uncovered and the 2 sheets are passed through the printing section.

The process of alternating development and partial exposure to UV light in the printing section is repeated at least 3 or 4 times and each time the black opaque sheet is positioned in a manner that it leaves an additional strip of $1''\times 8\frac{1}{2}''$ uncovered. Then, the diazotype sheet is exposed to a normal level of ammonia concentration in a commercial developing apparatus to fully develop the remaining area of the sheet which was not exposed to UV light. In order to compare the performance of different diazotype materials, a number of sheets to be tested, each one of a size of $2\frac{1}{2}''\times 8''$, are taped together at their long side, with Scotch tape and processed in the above-described manner. The resulting "development-step-wedges" can be compared visually or the reflection density of each development step is measured in a Photo Volt Reflection Densitometer and the measurement expressed as percentage of the maximum density in the fully-developed part of the sheet.

(b) Amine Development

A model PD 80—Pressure Development machine supplied by the Bruning Division of the Addressograph Multigraph Corp. is used. An amine solution (PD-80

Activator solution), commercially supplied by the same company serves as the activator.

A sensitized 2-component diazotype sheet is cut in half and one half of the sheet is processed, without any light exposure, through the development section of the PD 80 machine and 15 seconds after emerging from the development section, the sheet is given a UV flash exposure by passing it, face up, through the printing section of the machine. Thus all diazo compound which had not coupled in the first 15 seconds is destroyed and cannot further contribute to print dye formation.

The second half of the sheet is also processed, without light exposure, through the development section of the PD 80 machine but it is then left in subdued light for 30 minutes to reach maximum print dye development. The print dye reflection densities of both sheets are then measured in a Photo Volt Reflection Densitometer and the density value of the first half sheet is divided by the density value of the second half sheet. The thus obtained quotient is multiplied by 100 and expresses the degree of development in percent. A higher percentage figure indicates a better rate of development when 2 or more diazotype materials are compared.

Test No. 2—Daylight Discoloration of Print Background

A diazotype sheet is exposed to UV light in the printing section of a diazotype copying machine to decompose all the diazo contained in the sheet. It is then exposed to ammonia by passing it through the developing section of the machine. The sheet is then partly covered with a black opaque sheet and exposed in this form to daylight by taping the sheet to a window pane and leaving it for 3 to 7 days, depending on the season. In order to compare the performance of different diazotype materials, a number of diazotype sheets to be tested are taped together, treated in the same was as described above and exposed together in the window at the same time. After removing the test sheets from the window and separating the black opaque sheet, the reflection densities of the exposed area and of the covered area are measured in a Photo Volt Reflection Desitometer and the difference of the reflection density values is recorded as indicating the degree of discoloration. Comparing the reflection density values of different diazotype materials permits a rating of their resistance to discoloration.

Test No. 3—Accelerated Aging Test

Diazotype sheets are exposed for 24 hours at 50° C. to atmosphere of 50% room humidity. Thereafter they are half covered with a black opaque sheet and exposed to UV light in the printing section of a diazo copying machine, sufficiently to decompose all diazo in the non-covered area. The sheets are then fully developed with ammonia by passing the diazotype sheet through the developing section of a diazotype copying machine. A fresh sheet of the same diazotype paper is also half covered with a black opaque sheet and printed and developed in the same manner. The resulting prints are then measured in a Photo Volt Reflection Densitometer to determine the reflection densities of the bleached out areas (whites) and of the fully-developed areas (full tones). The differences of reflection densities from the aged and non-aged sheets of the white areas are recorded as print background discoloration from aging and of the full tones as print dye loss from aging. The aging test with a 50 percent room humidity (R.H.) atmosphere, in general, reflects a normal shelf life of 3 months. The aging test with a 75 percent R.H. atmosphere reflects behaviour under extremely adverse conditions.

Test No. 4—Sensitizing Composition Compatibility

Sensitizing compositions are solutions of different components, functional for the diazotype products. Their solution compatibility depends on the functional groups of the various components and their individual concentrations. Compatibility can be defined as solution stability against oily or crystalline precipitation. As a general rule, solution compatibility of compositions for the 2-component diazotype process improves with rising temperatures. The compatibility can be determined by the temperature at which the composition converts from a clear solution into a cloudy or milky dispersion or vice versa. This temperature value is referred to hereinafter as the "cloud point". A lower cloud point value indicates a better solution compatibility. For the determination of the cloud point, approx. 50 ml of the composition to be tested are placed into a 100 ml Erlenmeyer glass beaker, a thermometer is introduced and the Erlenmeyer is placed into a cold water bath with or without ice depending on the cloud point range. When the critical temperature range is reached, cloudiness starts near the wall of the Erlenmeyer. At that time, the Erlenmeyer is shaken and the temperature is recorded at which the entire solution becomes cloudy.

Test No. 5—Print Color Shade and Brilliancy

Diazotype materials are manufactured in different color grades such as blue, black, red and others. The print color quality is indicated by its optical density and by its shade and its brilliancy or hue. The optical density can be measured with a reflection densitometer. The brilliancy or hue is judged visually by comparing print colors obtained under normal developing conditions as specified in Federal Specification UUP 221 and may range from dull to highly brilliant shades.

Test No. 6—Printing Speed

The printing speed is determined according to Federal Specifications UUP 221-4.13.2 (Alternate ARMM Speed Rating Method), and is expressed as ARMM Speed Rating. A higher number indicates a faster printing speed when 2 or more samples are compared.

EXAMPLE 1

On a 3 airknife coating station diazotype coating machine for precoating, diazo sensitizing and backcoating and high velocity hot air convection drying after each coating application, a commercial opaque diazo base paper sheet of 72 g/m$^2$ basis weight is used for a series of tests. For each test, it is precoated identically in the first coating station with the following precoat composition:

| | |
|---|---|
| non colloidal silica (Pigment 2710S such as supplied by Andrews Paper & Chemical Co., Port Washington, New York) | 70 g |
| polyvinyl acetate, (50% aqueous dispersion) | 100 ml |
| antifoam agent | 1 g |
| mineral wax (40% aqueous dispersion) | 10 ml |
| water q.s. | 1000 ml |

Approximately 15 ml of the above precoat preparation are used for 1 $m^2$ of base paper.

After drying, the precoated paper is overcoated with one of the sensitizing solutions of the following formulae:

| | Trial #1 | #2 | #3 | #4 |
|---|---|---|---|---|
| citric acid | 20 g | | | |
| polyethyleneglycol* | 10 g | | | |
| Diazo #49 (M.W. 280)* | 8 g | | | |
| zinc chloride | 75 g | | | |
| saponin | 0.2 g | | | |
| thiourea | 50 g | | | |
| Coupler #111 (M.W. 262)* | 12 g | 13.5 g | 15 g | 20 g |
| Water q.s. | 1000 ml | | | |

| | Trial #5 | #6 | #7 | #8 | #9 | #10 | #11 | #12 |
|---|---|---|---|---|---|---|---|---|
| citric acid | 20 g | | | | | | | |
| polyethylene glycol, supra | 10 g | | | | | | | |
| Diazo #49 (M.W. 280)* | 8 g | | | | | | | |
| zinc chloride | 75 g | | | | | | | |
| saponin | 0.2 g | | | | | | | |
| 1,3-dimethylurea | 50 g | | | | | | | |
| urea | 40 g | | | | | | | |
| Coupler #111 (M.W. 262)** | 6 g | | | | | | | |
| water q.s. | 1000 ml | 7.5 g | 9 g | 10.5 g | 12 g | 13.5 g | 15 g | 20 g |

*Polyethylene glycol; Developaid, Andrews Paper & Chemical Co. M.W. 400.
Approximately 14 ml of the above sensitizing solutions are used for each 1 $m^2$ of base paper.
*Diazo #49: 1-diazo-4-N,N—diethylaniline chloride, ½ zinc chloride, Andrews Paper and Chemical Co., supra.
**Coupler #111: 2,3-dihydroxynaphthalene-6-sulfonic acid, sodium salt, Andrews Paper and Chemical Co., supra.

As shown above, Trial No. 6 uses diazo and coupler in stoichiometric relationship. After application of the sensitizing solution and consecutive drying, all test sheets were backcoated to obtain sheet flatness in the third coating station with the following solution:

| | |
|---|---|
| citric acid | 5 g |
| zinc chloride | 50 g |
| water, q.s. | 1000 ml |

dried again and wound up. Approximately 12 ml backcoat are used for 1 $m^2$ of base paper.

The trial sheets were then cut into smaller representative sheets for evaluation of their print performance. The evaluation showed:

1. Comparative Rates of Development and Degree of Development as percent of maximum dye formation:

| Trial # | 1 × developed | 3 × developed |
|---|---|---|
| 1 | 19 | 51 |
| 2 | 17.7 | 48 |
| 3 | 15 | 46 |
| 4 | 15.5 | 43 |
| 5 | 27 | 60 |
| 6 | 28 | 64 |
| 7 | 25 | 63 |
| 8 | 25 | 65 |
| 9 | 21 | 58 |
| 10 | 22 | 60 |
| 11 | 23 | 60 |
| 12 | 23 | 62 |

The recorded values indicate that, in general, increasing coupler concentrations tend to reduce the rate of development. A substantial difference of the development rates is observed between the group of the trials No. 1 through No. 4 containing thiourea and the group of trials No. 5 through No. 12 in which the thiourea is omitted and replaced by a mixture of 1,3-dimethylurea and urea.

2. Print Color Brilliancy

The series of trials Nos. 1 through 4 and the series of trials Nos. 5 through 12 are listed below in a manner to show tests with equal brilliancy level side by side

| Trial # | Trial # | |
|---|---|---|
| | 5 | dullest print color |
| 1 | 6 | increasing brilliancy |
| 2 | 7 | ↓ |
| 3 | 8 | ↓ |
| 4 | 9 | ↓ |
| | 10 | ↓ |
| | 11 | ↓ |
| | 12 | most brilliant print color |

The comparative evaluation shown above indicates that test No. 6 with a Coupler No. 111 concentration of 7.5 g/l gives the same brilliancy as test No. 1 with 12 g/l. A very satisfactory commercial print color brilliancy is obtained in test No. 9 with 12 g Coupler 111 per liter which is even superior to test No. 4 with 20 g/l. Accordingly, an economy of 40 percent Coupler 111 can be achieved through the use of a mixture of 1,3-dimethylurea and urea instead of thiourea along.

3. Sensitizing Solution Compatibility

The cloud points of representative samples of the sensitizing solutions from all tests were measured with the following results:

| Trial # | Cloud Point Temperature (°C.) |
|---|---|
| 1 | 17 |
| 2 | 17 |
| 3 | 19 |
| 4 | 18 |
| 5 | below 5 |
| 6 | below 5 |
| 7 | below 5 |
| 8 | below 5 |
| 9 | below 5 |

-continued

| Trial # | Cloud Point Temperature (°C.) |
|---|---|
| 10 | below 5 |
| 11 | below 5 |
| 12 | below 5 |

The measurements indicate that sensitizing solutions containing the mixture of 1,3-dimethylurea and urea instead of thiourea do not require minimum operating temperatures of 17° to 19° C. to prevent precipitation, but can be handled at substantially lower temperatures.

EXAMPLE 2

The procedure of Example No. 1, supra., is repeated in an identical manner except for replacing the sensitizing solutions as used therein with blueline sensitizing solutions composed as follows:

| | Trial #13 | #14 | #15 | #16 | #17 |
|---|---|---|---|---|---|
| citric acid | 20 g | | | | |
| polyethyleneglycol, supra | 10 g | | | | |
| Coupler #111, Andrews, supra. | 15 g | | | | |
| Diazo #49, supra. | 8 g | | | | |
| saponin | 0.2 g | | | | |
| zinc chloride | 75 g | | | | |
| thiourea | 80 g | — | — | — | 30 g |
| 1,3-dimethylurea | — | 50 g | — | 80 g | 50 g |
| urea | — | 30 g | 80 g | — | — |
| water, q.s. | 1000 ml | | | | |

The print evaluation of trials No. 13 through No. 17 gave the following results:

1. Comparative Rates of Development

Degree of Development as percent of maximum dye formation:

| | hot development in Ozamatic machine | | cold developed in Blue Ray |
|---|---|---|---|
| Trial # | 1 × developed | 3 × developed | machine |
| 13 | 51 | 70 | 77 |
| 14 | 65 | 83 | 91 |
| 15 | 47 | 68 | 79 |
| 16 | 73 | 85 | 97 |
| 17 | 65 | 85 | 95 |

It may be observed that trials No. 14, No. 16, and No. 17 are relatively close in performance and by far excel the rates of development of tests No. 13 and No. 15 with thiourea or urea alone compared to compositions containing 1,3-dimethylurea or its mixture with either one.

2. Print Color, Density, Brilliancy and Shade

| Trial # | Reflection Density | Brilliancy | Shade |
|---|---|---|---|
| 13 | 0.91 | fair | blue |
| 14 | 0.95 | very good | blue with slight violet hue |
| 15 | 0.95 | fair | blue (same as #13) |
| 16 | 0.97 | good | violet |
| 17 | 0.95 | very good | blue with slight violet hue (but less than #14) |

It is seen that trial No. 16 is off shade for commercial purposes. Trials No. 14 and No. 16 containing mixtures of 1,3-dimethylurea with urea and thiourea respectively excel by far over trials No. 13 and No. 15 without 1,3-dimethylurea.

3. Cloud Point of Sensitizing Solution:

| Trial # | | | | |
|---|---|---|---|---|
| 13 | 14 | 15 | 16 | 17 |
| 12° C. | below 5° C. | below 5° C. | below 5° C. | 11° C. |

4. Accelerated Aging:

| | Reflection Density increase of print background | | Reflection Density loss of maximum print dye | |
|---|---|---|---|---|
| Trial # | 50% R.H. | 75% R.H. | 50% R.H. | 75% R.H. |
| 13 | 0.03 | 0.08 | — | 0.03 |
| 14 | 0.01 | 0.03 | 0.03 | 0.09 |
| 15 | 0.03 | 0.07 | — | 0.06 |
| 16 | 0.03 | 0.08 | 0.08 | 0.12 |
| 17 | 0.01 | 0.03 | 0.01 | 0.09 |

It will be observed that trials No. 14 and No. 17 excel all others with their print background stability against the accelerated aging treatment and it appears to be a synergistic effect from the mixture of 1,3-dimethylurea with urea or thiourea while either of the 3 compounds alone shows pronounced visual discoloration from precoupling trials No. 13, No. 15 and No. 16).

Comparative Daylight Discoloration of Print Background:

| Trial # | Reflection Density increase of print background |
|---|---|
| 13 | 0.04 |
| 14 | 0.05 |
| 15 | 0.04 |
| 16 | 0.11 |
| 17 | 0.05 |

EXAMPLE 3

Example No. 1 is repeated in an identical manner except for replacement of the sensitizing solutions as used therein with the blueline sensitizing solutions as follows:

| Trial # | #18 | #19 | #20 | #21 | #22 | #23 | #24 | #25 | #26 |
|---|---|---|---|---|---|---|---|---|---|
| citric acid | 20 g | | | | | | | | |
| Diazo #48* | 10 g | | | | | | | | |
| dipropylene glycol | 15 g | | | | | | | | |
| sodium chloride | 5 g | | | | | | | | |
| zinc chloride | 30 g | | | | | | | | |
| saponin | 0.2 g | | | | | | | | |
| thiourea | 50 g | | | | 25 g | | | | |
| 1,3-dimethylurea | — | | | | 40 g | | | | |

-continued

| Trial # | #18 | #19 | #20 | #21 | #22 | #23 | #24 | #25 | #26 |
|---|---|---|---|---|---|---|---|---|---|
| urea | — | | | | 40 g | | | | |
| Coupler O** | 9 g | 10 g | 11 g | 12 g | 8 g | 9 g | 10 g | 11 g | 12 g |
| water, q.s. | 1000 ml | | | | | | | | |

Print evaluation of trials #18-26 gave the following results.

*Diazo #48: 1-diazo-4-N,N—dimethylaniline chloride, ½ zinc chloride, Andrews Paper and Chemical Co., supra.

**Coupler O: 2,7-dihydroxynaphthalene-3,6-disulfonic acid, disodium salt, Andrews Paper and Chemical Co., supra.

1. Comparative Rates of Development

| Trial # | Degree of Development as Percent of Max, Dye Formation: 1 × developed | 3 × developed |
|---|---|---|
| 18 | 38 | 66 |
| 19 | 40 | 67 |
| 20 | 38.5 | 65 |
| 21 | 38 | 62.5 |
| 22 | 44 | 71.5 |
| 23 | 43.5 | 70.5 |
| 24 | 42.5 | 71 |
| 25 | 42.5 | 69.5 |
| 26 | 42.5 | 69.5 |

It may be observed that the rtes of development of all trials No. 2- through No. 26 containing a mixture of 1,3-dimethylurea with urea and thiourea are superior to the trials No. 18 through No. 21 containing only thiourea.

2. Print Color Brilliancy

The series of trials No. 18 through No. 21 and the series of trials No. 22 through No. 26 are listed below in a manner to show tests with equal brilliancy level side by side.

| Trial # | Trial # | |
|---|---|---|
| 18 | | dullest print color |
| 19 | | increasing brilliancy |
| 20 | 22 | ↓ |
| 21 | 23 | ↓ |
| | 24 | ↓ |
| | 25 | ↓ |
| | 26 | most brilliant print color |

This comparative evaluation indicates that trial No. 22 with a Coupler O concentration of 8 g/l gives the same brilliancy as trial No. 20 with 11 g/l. Similarly, equal degrees of brilliancies are obtained from tests No. 23 with 9 g/l and test No. 21 with 12 g/l of the Coupler O. Accordingly, an economy of approximately 25 percent Coupler O can be achieved through the use of a mixture of 1,3-dimethylurea with urea and thiourea instead of urea alone.

EXAMPLE 4

The procedure of example No. 1 supra., is repeated except that the sensitizing solutions as used therein are replaced with the blueline sensitizing solutions composed as follows:

| Trial # | #27 | #28 | #29 | #30 | #31 | #32 |
|---|---|---|---|---|---|---|
| citric acid | 20 g | | | | | |
| polyethyleneglycol, supra | 10 g | | | | | |
| Coupler #111, Andrews, supra. | 15 g | | | | | |

-continued

| Trial # | #27 | #28 | #29 | #30 | #31 | #32 |
|---|---|---|---|---|---|---|
| Diazo #49, Andrews, supra. | 8 g | | | | | |
| saponin | 0.2 g | | | | | |
| zinc chloride | 75 g | | | | | |
| thiourea | 50 g | | | — | — | — |
| 1,3-dimethylurea | — | — | — | 50 g | | |
| urea | 30 g | | | | | |
| aluminum sulfate | — | 10 g | 20 g | — | 10 g | 20 g |
| water, q.s. | 1000 ml | | | | | |

The evaluation of prints made from the papers of this example show as follows:

1. Comparative Rate of Development:

| Trial # | Degree of Development as percent of max. Dye Formation: 1 × developed | 3 × developed |
|---|---|---|
| 27 | 32 | 71 |
| 28 | 26 | 63 |
| 29 | 24 | 50 |
| 30 | 48 | 85 |
| 31 | 43 | 81 |
| 32 | 37 | 71 |

| Trial # | Reflection Densities from Rate of Development: 1 × developed | 3 × developed |
|---|---|---|
| 27 | 0.29 | 0.65 |
| 28 | 0.23 | 0.56 |
| 29 | 0.20 | 0.41 |
| 30 | 0.43 | 0.75 |
| 31 | 0.39 | 0.73 |
| 32 | 0.33 | 0.63 |

| 2. Trial # | Comparative Reflection Density of Print Dyes after Full Development: |
|---|---|
| 27 | 0.91 |
| 28 | 0.89 |
| 29 | 0.82 |
| 30 | 0.89 |
| 31 | 0.89 |
| 32 | 0.88 |

It will be observed from the above that the addition of 2% aluminum sulfate reduces the print dye density by approximately 10% in the formulation containing thiourea while the density loss is only approximately 1% for the formulation containing a mixture of 1,3-dimethylurea with urea to replace the thiourea. Also it will be appreciated that a print dye reflection density of 0.29 represents a weak but readable print contrast while a density of 0.20 is highly unsatisfactory. It will also be observed from the above that the presence of a mixture of 1,3-dimethylurea with urea in replacement of thiourea alone greatly increases the print line contrast even of underdeveloped prints. Even in the presence of 2% aluminum sulfate there are obtained print lines with an increased print contrast in cases of underdevelopment.

EXAMPLE 5

The procedure of Example No. 1 supra., is repeated except that the sensitizing solutions as used therein are replaced with redline compositions composed as follows:

| Trial # | #33 | #34 |
|---|---|---|
| p-toluene sulfonic acid | 15 g | |
| polyethyleneglycol, supra. | 10 g | |
| Coupler #375* | 10 g | |
| isopropyl alcohol | 10 cc | |
| Diazo #59 | 10 g | |
| 1,3-dimethylurea | — | 50 g |
| thiourea | 30 g | |
| saponin | 0.2 g | |
| zinc chloride | 40 g | |
| water, q.s. | 1000 ml | |

*Coupler #375: 4-bromo-alpha-resorcylic acid, Andrews Paper & Chemical Co., Inc., supra.
**Diazo #59: 1-diazo-2,5-diethoxy-4-morpholino benzene chloride, ½ zinc chloride Andrews Paper & Chemical Co., Inc., supra.

The solution of trial No. 33 generated abundant crystallization upon short standing and could not be used for coating.

Trial No. 34, containing a mixture of 1,3-dimethylurea with thiourea instead of thiourea alone produced a clear and stable sensitizing solution and resulted in a fast printing diazotype paper with bright red print lines. The red print dye did not tend to shift color towards brown or violet when exposed to environmental atmosphere as many redline diazotypes tend to do.

EXAMPLE 6

The procedure of Example No. 1 supra., is repeated except that the sensitizing solutions used therein are replaced with the blueline sensitizing solutions composed as follows:

| Trial # | #35 | #36 | #37 | #38 | #39 | #40 | #41 | #42 | #43 |
|---|---|---|---|---|---|---|---|---|---|
| citric acid | 20 g | | | | | | | | |
| polyethyleneglycol, supra. | 10 g | | | | | | | | |
| Coupler #111, supra. | 10 g | | | | | | | | |
| Diazo #49, supra. | 8 g | | | | | | | | |
| saponin | 0.2 g | | | | | | | | |
| zinc chloride | 75 g | | | | | | | | |
| thiourea | — | 10 g | 20 g | 40 g | 80 g | — | — | — | — |
| 1,3-dimethyl-urea | — | — | — | — | — | 10 g | 20 g | 40 g | 80 g |
| urea | — | — | — | — | — | 6 g | 12 g | 24 g | 48 g |
| water, q.s. | 1000 ml | | | | | | | | |

Upon evaluation of prints prepared in Example 6, the following characteristics are observed.

| 1. Comparative Rate of Development | Degree of Development as Percent of Max. Dye Formation | |
|---|---|---|
| Trial # | 1 × developed | 3 × developed |
| 35 | 48 | 68 |
| 36 | 49 | 72 |
| 37 | 48 | 71 |
| 38 | 45 | 73 |
| 39 | 31 | 69 |
| 40 | 61 | 79 |
| 41 | 57 | 77 |
| 42 | 57 | 83 |
| 43 | 54 | 87 |

The rate of development test results shown above indicate that increasing thiourea additions to the sensitizing solution reduces the rate of development while the addition of a mixture of 1,3-dimethylurea and urea at a level of 1 percent and 0.6 percent, respectively, substantially increases the rate of development.

2. Print Color Brilliancy: The trials are listed in the order of degree of brilliancy:

| Trial # | |
|---|---|
| 43 | most brilliant print color |
| 42 | decreasing ↓ brilliancy |
| 41 | ↓ |
| 40 | ↓ |
| 39 | ↓ |
| 38 | ↓ |
| 37 | ↓ |
| 36 | dullest print color |

Trial No. 35, containing neither thiourea nor the mixture of 1,3-dimethylurea with urea has a blue-violet print dye. The addition of thiourea first decreases the brilliancy but will, with a larger concentration, increase print dye brilliancy and shift the shade away from violet, towards blue.

It may be observed that the addition of the mixture of 1,3-dimethylurea with urea has hardly an effect upon the print dye shade, but greatly increases the print dye brilliancy.

EXAMPLE 7

The procedure of Example 1, supra., is repeated except that the sensitizing solutions used therein are replaced with the blueline sensitizing solutions composed as follows:

| Trial # | 44 | 45 | 46 | 47 | 48 |
|---|---|---|---|---|---|
| citric acid | 20 g | | | | |
| Coupler #111, supra. | 15 g | | | | |
| Diazo #49, supra. | 8 g | | | | |
| saponin | 0.2 g | | | | |
| zinc chloride | 75 g | | | | |
| thiourea | 30 g | | | | |

-continued

| Trial # | 44 | 45 | 46 | 47 | 48 |
|---|---|---|---|---|---|
| 1,3-dimethylurea | — | 50 g | — | — | — |
| polyethyleneglycol supra | — | — | 10 g | 20 g | — |
| allylhydroxyethyl-thiourea | — | — | — | — | 30 g |
| water, q.s. | 1000 ml | | | | |

Evaluation of prints made in trials Nos. 44–48 gave the following results.

1. Comparative Rates of Development and Degree of Development As Percent of Maximum Dye Formation:

| Trial # | 1 × developed | 3 × developed |
|---|---|---|
| 44 | 44 | 68 |
| 45 | 54 | 81 |
| 46 | 56 | 77 |
| 47 | 60 | 80 |
| 48 | 46 | 75 |

2. Print Color Brilliancy:
The trials are listed in the order of degree of brilliancy:

| Trial # | |
|---|---|
| 45 | most brilliant print color |
| 48 | decreasing ↓ brilliancy |
| 47 | ↓ |
| 46 | ↓ |
| 44 | dullest print color |

3. Accelerated Aging test results:

| Trial # | Reflection Density increase of print background 50% R.H. | 75% R.H. |
|---|---|---|
| 44 | 0.005 | 0.049 |
| 45 | 0.01 | 0.045 |
| 46 | 0.005 | 0.045 |
| 47 | 0.03 | 0.057 |
| 48 | 0.01 | 0.049 |

4. Printing Speeds:

| Trial # | ARMM Speed Rating |
|---|---|
| 44 | 128 |
| 45 | 164 |
| 46 | 138 |
| 47 | 138 |
| 48 | 154 |

It will be observed from the above that polyglycol additions (trials No. 46 and No. 47) increase the printing speed of the control trial No. 44 by 8% and allylhydroxyethyl thiourea (trial No. 48) brings the printing speed up by 20%. The greatest increase of the printing speed (by 28%) is obtained by the addition of 1,3-dimethylurea to thiourea as shown in trial No. 45. Trial No. 45 (containing 1,3-dimethylurea and thiourea) produced the best overall performance. Trial No. 47 with polyglycol at a 2% level showed a very similar rate of development as trial No. 45 but the poorer aging test indicates that a 2% concentration of polyglycol is already too high for practical applications. Trial No. 48 showed that 3% hydroxy ethyl-allyl thiourea yielded a substantially poorer rate of development than trial No. 45 for similar but slightly poorer shelf life expectancy.

The best print color brilliancy was obtained with trial No. 45.

Solution Stability

Testing of representative samples of the sensitizing solutions used in trials Nos. 44–48 showed the following cloud points.

| Trial # | 44 | 45 | 46 | 47 | 48 |
|---|---|---|---|---|---|
| Cloud Point of Sensitizing Solutions: | 13° C. | below 0° C. | 10° C. | 7° C. | 12° C. |

The best solution stability against precipitation was obtained with trial No. 45 as evidenced by the lowest cloud point temperature.

EXAMPLE 8

The procedure of Example No. 1 supra., is repeated except for the replacement of sensitizing solutions as used therein by blackline compositions as follows:

| Trial | #49 | #50 |
|---|---|---|
| citric acid | 20 g | |
| 1,3-dimethylurea | 60 g | — |
| thiourea | 40 g | 60 g |
| Coupler #910* | 8 g | |
| Coupler O | 10.5 g | |
| Diazo #48 | 10 g | |
| isopropyl alcohol | 10 ml | |
| saponin | 0.2 g | |
| aluminum sulfate | 60 g | |
| zinc chloride | 30 g | |
| polyvinyl acetate dispersion (50% solids) | 10 ml | |
| water, q.s. | 1000 ml | |

*Coupler #910: 2,4,3'-trihydroxydiphenyl, Andrews Paper & Chemical Co., Inc., supra.

Upon test evaluation of the resulting diazo coated papers, the following are observed.

1. Comparative Rate of Development:

| Trial # | Degree of Development as Percent of Maximum Dye Formation 1 × developed | 3 × developed |
|---|---|---|
| 49 | 45 | 80 |
| 50 | 33 | 61 |

2. Accelerated Aging Test Results:

| Trial # | Reflection Density increase of Print Background 50% R.H. | 75% R.H. |
|---|---|---|
| 49 | 0.01 | 0.02 |
| 50 | 0.01 | 0.02 |

3. The Maximum Print Dye Density

| Trial # | #49 | #50 |
|---|---|---|
| | 1.30 | 1.22 |

Representative samples of the sensitizing solutions were tested for cloud point and showed:

| Trial # | #49 | #50 |
|---|---|---|
| Cloud Point of Sensitizing Solutions: (determined without addition of polyvinylacetate) | 19° C. | 28° C. |

As shown, the test results of trial No. 49 containing a mixture of 1,3-dimethylurea excel over trial No. 50 containing thiourea alone by (1) a better solution stability indicated by the lower cloud point;

(2) a substantially higher rate of development, for identical shelf life expectancy.

EXAMPLE 9

The procedure of Example No. 1 supra., is repeated except for replacement of the precoat and sensitizing preparations, which have the following compositions:

| Trial # | #51 | #52 | #53 |
|---|---|---|---|
| Precoat | | | |
| non-colloidal silica (Pigment 2710S, supra., supplied by Andrews Paper & Chemical Co.) | 70 g | | |
| 50% aqueous dispersion of polyvinyl acetate | 100 ml | | |
| antifoam agent* | 1 g | | |
| 40% aqueous dispersion of mineral wax | 10 ml | | |
| 1,3-dimethylurea | 50 g | — | — |
| thiourea | 30 g | — | — |
| water, q.s. | 1000 ml | | |
| Sensitizing Solution: | | | |
| citric acid | 20 g | | |
| polyethyleneglycol, supra. | 10 g | | |
| Coupler #111, supra. | 15 g | | |
| Diazo #49, supra. | 8 g | | |
| saponin | 0.2 g | | |
| zinc chloride | 75 g | | |
| 1,3-dimethylurea | — | 50 g | — |
| thiourea | — | 30 g | 50 g |
| water, q.s. | 1000 ml | | |

*Foammaster KFS, Nopco Chemical Co.

Evaluation of the prepared diazotype papers revealed the following characteristics.

1. Comparative Rate of Development:

| Trial # | Degree of Development as Percent of Maximum Dye Formation | |
|---|---|---|
| | 1 × developed | 3 × developed |
| 51 | 69 | 84 |
| 52 | 62 | 86 |
| 53 | 52 | 73 |

The above rate of development evaluation indicates that the incorporation of the mixture of 1,3-dimethylurea and thiourea into the precoat (trial No. 51) or into the sensitizing solution (trial No. 52) resulted in a substantially superior rate of development than was obtained from trial No. 53 containing thiourea only.

EXAMPLE 10

The procedure of Example No. 1, supra., is repeated except for replacing the sensitizing solutions as used therein with the blueline sensitizing solutions composed as follows:

| Trial # | #54 | #55 |
|---|---|---|
| citric acid | 15 g | |
| Coupler #111, supra | 15 g | |
| Diazo #88* | 10 g | |
| saponin | 0.2 g | |
| zinc chloride | 50 g | 25 g |
| isopropyl alcohol | 10 ml | |
| thiourea | 30 g | |
| 1,3-dimethylurea | — | 50 g |
| polyethyleneglycol, supra | 20 g | 10 g |
| caffein | 10 g | — |

-continued

| Trial # | #54 | #55 |
|---|---|---|
| water, q.s. | 1000 ml | |

*Diazo #88: 1-diazo-3-methyl-4-pyrrolidino benzene chloride, zinc chloride Andrews Paper & Chemical Co., supra.

1. Comparative Rate of Development:

| Trial # | Degree of Development as Percent of Maximum Dye Formation | |
|---|---|---|
| | 1 × developed | 3 × developed |
| 54 | 81 | 86 |
| 55 | 83 | 91 |

2. Maximum Print Dye After Full Development

| Trial # | Photo Volt Reflection Density |
|---|---|
| 54 | 0.92 |
| 55 | 0.98 |

3. Printing Speed:

| Trial # | ARMM Speed Rating |
|---|---|
| 54 | 280 |
| 55 | 320 |

It will be seen that trial No. 55 developed faster than trial No. 54 despite the reduction of the polyglycol concentration by one half. Noticeably outstanding are the increased maximum print dye density from 0.92 to 0.98 and the increased printing speed by 14% of trial No. 55 over trial No. 54.

Measurement of cloud points for the sensitizing solutions showed:

| Trial # | #54 | #55 |
|---|---|---|
| Cloud Point of Sensitizing Solutions: | 20° C. | 10° C. |

As the cloud points indicate, trial No. 55 even without caffein as solubilizer produced a more stable solution than trial No. 54.

EXAMPLE 11

The procedure of Example No. 1, supra., is repeated except for the replacement of the sensitizing solutions as used therein with blueline sensitizing solutions composed as follows:

| Trial # | #56 | #57 |
|---|---|---|
| citric acid | 5 g | |
| 70% methane sulfonic acid | 7.5 g | |
| caffein | 10 g | |
| Coupler #144* | 10 g | |
| Diazo #59, supra. | 8 g | |
| saponin | 0.2 g | |
| zinc chloride | 20 g | |
| thiourea | 15 g | — |
| urea | — | 15 g |
| 1,3-dimethylurea | — | 50 g |
| water, q.s. | 1000 ml | |

*Coupler #144: 2-hydroxy-3-carboxylic acid-(3'-N—morpholinopropyl)amide, Andrews Paper & Chemical Co., supra.

The evaluation of representative diazotype papers prepared in the above trials 56 and 57 gave the following results:

| 1. Comparative Rate of Development | | |
|---|---|---|
| (a) Ammonia Vapor Development in Ozamatic: | | |
| | Degree of Development as Percent of Maximum Dye Formation | |
| Trial # | 1 × developed | 3 × developed |
| 56 | 69 | 79 |
| 57 | 81 | 89 |
| (b) Liquid Amine Development in PD 80 Pressure Development Processor: | | |
| Trial # | Print Dye Formation 15 Seconds after development | |
| 56 | 74 | |
| 57 | 79 | |

EXAMPLE 12

On a coating machine equipped with one wire rod coating station and a hot air convection dryer, a transparent sheet is coated with a lacquer preparation of the following composition:

| | |
|---|---|
| cellulose acetate butyrate | 210 g |
| dioctyl adipate | 12 g |
| methyl alcohol | 400 ml |
| methyl glycol ether | 30 ml |
| n-butyl alcohol | 40 ml |
| isopropyl alcohol | 130 ml |
| methyl ethyl ketone | 400 ml |
| sulfosalicylic acid | 12 g |

After drying, the deposited coating weight was observed to be 8 g per square meter. The lacquered material was passed a second time through the coating machine and overcoated with the following sensitizing compositions:

| Trial # | #58 | #59 |
|---|---|---|
| acetic acid (glacial) | 15 ml | |
| sulfosalicylic acid | 20 g | |
| tartaric acid | 30 g | |
| Diazo #88, supra | 25 g | |
| Coupler RX* | 25 g | |
| thiourea | 10 g | |
| 1,3-dimethylurea | — | 50 g |
| methyl alcohol | 240 ml | |
| ethyl alcohol | 290 ml | |
| n-butyl alcohol | 140 ml | |
| isopropyl alcohol | 330 ml | |

*Coupler RX: 2,4-dihydroxy-benzoic acid-ethanolamide, Andrews Paper & Chemical Co., supra.

After drying, a brownline diazotype reproducible is obtained. It was evaluated with the following results:

1. Rate of Development and Reprint Opacity: The rate of development was determined in an Ozamatic diazo copying machine as described in the earlier cited specifications.

The "development step wedges" thus obtained were used to determine the reprint opacity at the different levels of development; reprints on a commercial blackline ammonia, diazotype paper, with a ARMM Speed Rating of 82 and a maximum reflection density of 1.6, were made at a copying speed which, after ammonia development, left in the completely burned-out step of the "development step wedge" of the reproducible, a reflection density of 0.05 above burn-out.

| | Rate of Development of Reproducible Diazotype as percent of maximum dye formation of reproducible | | Reprint Opacity of Reproducible Diazotype as percent of maximum obtainable dye formation on diazotype copy | |
|---|---|---|---|---|
| Trial # | #58 | #59 | #58 | #59 |
| 1 × developed | 30% | 35% | 27% | 42% |
| 3 × developed | 49% | 61% | 57% | 74% |
| fully developed | 100% | 100% | 86% | 89% |

The fully developed reflection densities were for trial No. 58: 1.77 and for trial No. 59: 1.74.

The importance of the improved rate of development of trial No. 59 over trial No. 58 containing no dimethylurea becomes obvious in the far excelling reprint opacities, particularly in view of the increased printing speed achieved (30%), as the objective of reproducibles is their use to make reprints.

| 2. Printing Speed | | |
|---|---|---|
| Trial # | #58 | #59 |
| ARMM Speed Rating | 51 | 67 |

Trial No. 59 with the addition of 1,3-dimethylurea prints approximately 30% faster than the control trial No. 58.

| 3. Accelerated Aging | | |
|---|---|---|
| Trial # | 50% R.H. | 75% R.H. |
| | Reflection Density increase of print background | |
| 58 | 0.01 | 0.04 |
| 59 | 0.01 | 0.03 |
| | Reprint Opacity as percent of maximum obtainable dye formation on diazotype copy | |
| 58 | 89% | 89% |
| 59 | 89% | 89% |

The aging tests indicate that material from both trials resists well against the aging conditions and can be expected to have equally good shelf life.

4. Ultraviolet Light Fading Test

Sheets of test No. 58 and No. 59 were half covered with an opaque sheet and processed in an Ozamatic copying machine in a manner that the exposed area was completely burned out while the covered area was developed to maximum print dye density.

The obtained prints were aired for dissipation of the ammonia for 30 minutes and then partially covered with an opaque sheet in a manner to have one half of the burned-out area and one-half of the print dye area covered. The sheets were then passed through the printing section of the Ozamatic 30 times at a speed of 30 inches per minute, and the change of reflection density of the burned-out areas and of the print dye areas were measured in a Photo Volt Reflection Densitometer. The results are shown below.

| Trial # | Increase of print background density | change of print dye density |
|---|---|---|
| 58 | 0.045 | not measurable |
| 59 | 0.035 | not measurable |

The results indicate that trial No. 59 containing thiourea with the addition of 1,3-dimethylurea is more resistant to UV print light than trial No. 58 containing thiourea alone. Trial No. 59 can be thus considered as a more permanent diazotype reproducible than the control trial No. 58.

What is claimed is:

1. A light sensitive diazo coating composition which comprises;

a light sensitive diazonium compound;

1,3-dimethylurea;

a diazonium stabilizing proportion of citric acid; and a print accelerating proportion of a compound selected from the group consisting of urea, thiourea and mixtures thereof.

2. The composition of claim 1 wherein the compound selected is urea.

3. The composition of claim 1 wherein the compound selected is thiourea.

4. The composition of claim 1 wherein the compound selected is a mixture of urea and thiourea.

5. The composition of claim 1 which additionally comprises an azo coupler.

6. The composition of claim 1 wherein said diazonium compound is selected from 1-diazo-4-N,N-diethylaniline chloride, 1-diazo-4-N,N-dimethylaniline, 1-diazo-2,5-diethoxy-4-morpholino benzene chloride and 1-diazo-3-methyl-4-pyrrolidino benzene chloride.

7. The composition of claim 5 wherein said azo coupler is 2,3-dihydroxynaphthalene-6-sulfonic acid and the diazonium compound is selected from 1-diazo-4-N,N-diethylaniline chloride and 1-diazo-3-methyl-4-pyrrolidino benzene chloride.

8. The composition of claim 5 wherein said azo coupler is 2,7-dihydroxynaphthalene-3,6-disulfonic acid and the diazonium compound is 1-diazo-4-N,N-dimethylaniline chloride.

9. The composition of claim 5 wherein said azo coupler is 4-bromo-alpha-resorcylic acid and the diazonium compound is 1-diazo-2,5-diethoxy-4-morpholino benzene chloride.

10. The composition of claim 5 wherein said azo coupler is 2,4,3'-trihydroxy diphenyl and the diazonium compound is 1-diazo-4-N,N-dimethylaniline chloride.

11. The composition of claim 5 wherein said azo coupler is 2-hydroxy-3-carboxylic acid-(3'N-morpholino-propyl) amide and the diazonium compound is 1-diazo-2,5-diethoxy-4-morpholino benzene chloride.

12. The composition of claim 5 wherein said azo coupler is 2,4-dihydroxy-benzoic acid-ethanolamide and the diazonium compound is 1-diazo-3-methyl-4-pyrrolidino benzene chloride.

13. A light sensitive diazotype reproduction material which comprises;

a base support; and a coating on the support, which comprises in admixture a light sensitive diazonium compound, 1,3-dimethylurea, a diazonium stabilizing proportion of citric acid and a print accelerating proportion of a compound selected from the group consisting of urea, thiourea and mixtures thereof.

14. The material of claim 13 wherein the coating contains from 140 to 2000 mg. of 1,3-dimethylurea per square meter of base support.

15. The material of claim 14 which coating also contains from 50 to 1500 mg. of the compound selected per square meter of base support.

16. The material of claim 15 wherein said admixture includes an azo coupler.

17. The material of claim 15 wherein the compound selected is in a proportion of from 50 to 150 mg/square meter.

18. The material of claim 17 wherein said admixture includes an azo coupler.

19. The material of claim 14 wherein said admixture includes an azo coupler.

20. The material of claim 13 wherein said admixture includes an azo coupler.

21. The material of claim 20 wherein said azo coupler is 2,3-dihydroxynaphthalene-6-sulfonic acid and the diazonium compound is selected from 1-diazo-4-N,N-diethylaniline chloride and 1-diazo-3-methyl-4-pyrrolidino benzene chloride.

22. The material of claim 20 wherein said azo coupler is 2,7-dihydroxynaphthalene-3,6-disulfonic acid and the diazonium compound is 1-diazo-4-N,N-dimethylaniline chloride.

23. The material of claim 20 wherein said azo coupler is 4-bromo-alpha-resorcylic acid and the diazonium compound is 1-diazo-2,5-diethoxy-4-morpholino benzene chloride.

24. The material of claim 20 wherein said azo coupler is 2,4,3'-trihydroxy diphenyl and the diazonium compound is 1-diazo-4-N,N-dimethylaniline chloride.

25. The material of claim 20 wherein said azo coupler is 2-hydroxy-3-carboxylic acid-(3'-N-morpholinopropyl) amide and the diazonium compound is 1-diazo-2,5-diethoxy-4-morpholino benzene chloride.

26. The material of claim 20 wherein said azo coupler is 2,4-dihydroxy-benzoic acid-ethanolamide and the diazonium compound is 1-diazo-3-methyl-4-pyrrolidino benzene chloride.

27. The material of claim 13 wherein the compound selected is urea.

28. The material of claim 13 wherein the compound selected is thiourea.

29. The material of claim 13 wherein the compound selected is a mixture of urea and thiourea.

30. The material of claim 13 wherein said diazonium compound is selected from 1-diazo-4-N,N-diethylaniline chloride, 1-diazo-4-N,N-dimethylaniline, 1-diazo-2,5-diethoxy-4-morpholino benzene chloride and 1-diazo-3-methyl-4-pyrrolidino benzene chloride.

* * * * *

UNITED STATES PATENT AND TRADEMARK OFFICE

CERTIFICATE OF CORRECTION

PATENT NO. : 4,401,744

DATED : August 30, 1983

INVENTOR(S) : Peter Muller

It is certified that error appears in the above-identified patent and that said Letters Patent is hereby corrected as shown below:

Col. 2, line 11 bridging line 12; "hydroscopic" should read -- hygroscopic --

Col. 2, line 33; "thioure" should read -- thiourea --

Col. 7, line 37; "was" should read -- way --

Col. 7, line 51; "room" should read -- relative --

Col. 7, line 68; "room" should read -- relative --

Col. 9, line 25; move the proportions "7.5g, 9g, 10.5g, 12g, 13.5g, 15g, 20g" up one line to indicate that they are proportions of the Coupler #111 for trials 6-12, inclusive.

Col. 10, line 53; "along" should read -- alone --

Col. 13, line 26; "rtes" should read -- rates --

Col. 13, line 27; "No. 2-" should read -- No. 22 --

Col. 13, line 55; "urea" should read -- thiourea --

Col. 15, line 17; "Diazo #59" should read -- Diazo #59 ** --

UNITED STATES PATENT AND TRADEMARK OFFICE

CERTIFICATE OF CORRECTION

PATENT NO. : 4,401,744

DATED : August 30, 1983

INVENTOR(S) : Peter Muller

It is certified that error appears in the above-identified patent and that said Letters Patent is hereby corrected as shown below:

Col. 19, line 18; Delete " * " after "antifoam agent".

Col. 19, line 32; Delete " *Foammaster KFS, Nopco Chemical Co."

Col. 24, Claim 19, line 1; "claim 14" should read -- claim 15 --

Col. 24, Claim 30, line 3; after "dimethylaniline" insert

-- chloride --

Signed and Sealed this

*Fourteenth* Day of *August 1984*

[SEAL]

*Attest:*

GERALD J. MOSSINGHOFF

*Attesting Officer*

*Commissioner of Patents and Trademarks*